US005196661A

United States Patent [19]

Shimozono et al.

[11] Patent Number: 5,196,661

[45] Date of Patent: Mar. 23, 1993

[54] ACCELERATION SENSOR

[75] Inventors: Shigeru Shimozono; Kazuo Yoshimura; Ryo Sato, all of Kanagawa, Japan

[73] Assignee: Takata Corporation, Tokyo, Japan

[21] Appl. No.: 789,956

[22] Filed: Nov. 12, 1991

[30] Foreign Application Priority Data

Dec. 25, 1990 [JP] Japan ..... 2-405799

[51] Int. Cl.[5] ..... H01H 35/14

[52] U.S. Cl. ..... 200/61.45 M; 200/61.53

[58] Field of Search ..... 200/61.45 R-61.53

[56] References Cited

U.S. PATENT DOCUMENTS

| | | | |
|---|---|---|---|
| 4,329,549 | 5/1982 | Breed | 200/61.45 M |
| 4,827,091 | 5/1989 | Behr | 200/61.45 M |
| 4,933,515 | 6/1990 | Behr et al. | 200/61.45 M |
| 5,010,217 | 4/1991 | Hueniken et al. | 200/61.45 R |
| 5,053,588 | 10/1991 | Bolender | 200/61.45 R |

*Primary Examiner*—J. R. Scott

*Attorney, Agent, or Firm*—Kanesaka and Takeuchi

[57] ABSTRACT

An accelerator sensor comprises a cylinder of a conductive material, a magnetized inertial member mounted in the cylinder so as to be movable longitudinally of the cylinder, a conductive member mounted at least on one end surface of the inertial member that is on the side of one longitudinal end of the cylinder, a pair of electrodes disposed at this one longitudinal end of the cylinder, and an attracting member disposed near the other longitudinal end of the cylinder. When the conductive member of the inertial member comes into contact with the electrodes, these electrodes are caused to conduct via the conductive member. The attracting member is made of a magnetic material such that the attracting member and the inertial member are magnetically attracted toward each other. The cylinder has a thick wall portion at the end of the cylinder where the electrodes are located. Chattering of the electrodes is prevented by a strong magnetic force of the thick wall portion which reduces the impact speed of the inertial member prior to engagement of the conductive member and the electrodes.

3 Claims, 2 Drawing Sheets

ACCELERATION SENSOR

FIELD OF THE INVENTION

The present invention relates to an acceleration sensor and, more particularly, to an acceleration sensor adapted to detect a large change in the speed of a vehicle caused by a collision or the like.

BACKGROUND OF THE INVENTION

An acceleration sensor of this kind is described in U.S. Pat. No. 4,827,091. This known sensor comprises a cylinder made of a conductive material, a magnetized inertial member mounted in the cylinder so as to be movable longitudinally of the cylinder, a conductive member mounted at least on one end surface of the inertial member which is on the side of one longitudinal end of the cylinder, a pair of electrodes disposed at one longitudinal end of the cylinder, and an attracting member disposed near the other longitudinal end of the cylinder. When the conductive member of the magnetized inertial member makes contact with the electrodes, these electrodes are caused to conduct via the conductive member. The attracting member is made of such a magnetic material that the attracting member and the inertial member are magnetically attracted towards each other.

In this acceleration sensor, the magnetized inertial member and the attracting member attract each other. When no or almost no acceleration is applied to the sensor, the inertial member is at rest at the other end in the cylinder.

If a relatively large acceleration acts on this acceleration sensor, the magnetized inertial member moves against the attracting force of the attracting member. During the movement of the inertial member, an electrical current is induced in this cylinder, producing a magnetic force which biases the inertial member in the direction opposite to the direction of movement of the inertial member. Therefore, the magnetized inertial member is braked, so that the speed of the movement is reduced.

When the acceleration is less than a predetermined magnitude,or threshold value, the magnetized inertial member comes to a stop before it reaches the front end of the cylinder. Then, the inertial member is pulled back by the attracting force of the attracting member.

When the acceleration is greater than the predetermined magnitude, or the threshold value, e.g., the vehicle carrying this acceleration sensor collides with an object, the inertial member arrives at one end of the cylinder. At this time, the conductive layer on the front end surface of the inertial member makes contact with both electrodes to electrically connect them with each other. If a voltage has been previously applied between the electrodes, an electrical current flows when a short circuit occurs between them. This electrical current permits detection of collision of the vehicle.

In the prior art, the wall thickness of the cylinder is equal from one end to the other end as shown in FIG. 3.

It was found by the inventors that the inertial member collides with the electrodes with a large speed in the cylinder having the uniform wall thickness, whereby the electrodes vibrate with large amplitude. It causes "chattering " wherein the inertial member and the electrode make repeatedly contact and uncontact with each other, so that a detecting electronic circuit requires various filters to filter noises caused by the chattering.

SUMMARY OF THE INVENTION

It is an object of the present invention to provide an acceleration sensor which has a cylinder made of a conductive material and incorporating a magnetized inertial member and in which the inertial member colliding with electrodes is braked with a large magnetic force produced by an electrical current.

It is another object of the invention to provide an acceleration sensor capable of preventing chattering of the electrodes by reducing the impact speed of the member against the electrodes.

The novel acceleration sensor comprises: a cylinder made of a conductive material; a magnetized inertial member mounted in the cylinder so as to be movable longitudinally of the cylinder; a conductive member mounted on the end surface of the inertial member which is on the side of one longitudinal end of the cylinder; a pair of electrodes which are disposed at this one longitudinal end of the cylinder and which, when the conductive member of the inertial member makes contact with the electrodes, are caused to conduct via the conductive member; and an attracting member disposed near the other longitudinal end of the cylinder and made of a magnetic material which magnetically attracts the inertial member. The cylinder has a thick portion at the end where the electrodes are disposed such that the thick portion has a larger outside diameter than the other portion of the cylinder.

In the present invention, when the inertial member or magnet assembly is advanced up to the front end of the cylinder, a larger electrical current is induced in the thick portion than in the other portion of the cylinder because of the thick wall thickness thereof. Therefore, the magnet assembly is braked with a large braking force near the end of the cylinder, so that it contacts the electrodes with a small impact speed whereby chattering of the electrodes is prevented.

DETAILED DESCRIPTION OF THE INVENTION

Figure 1:
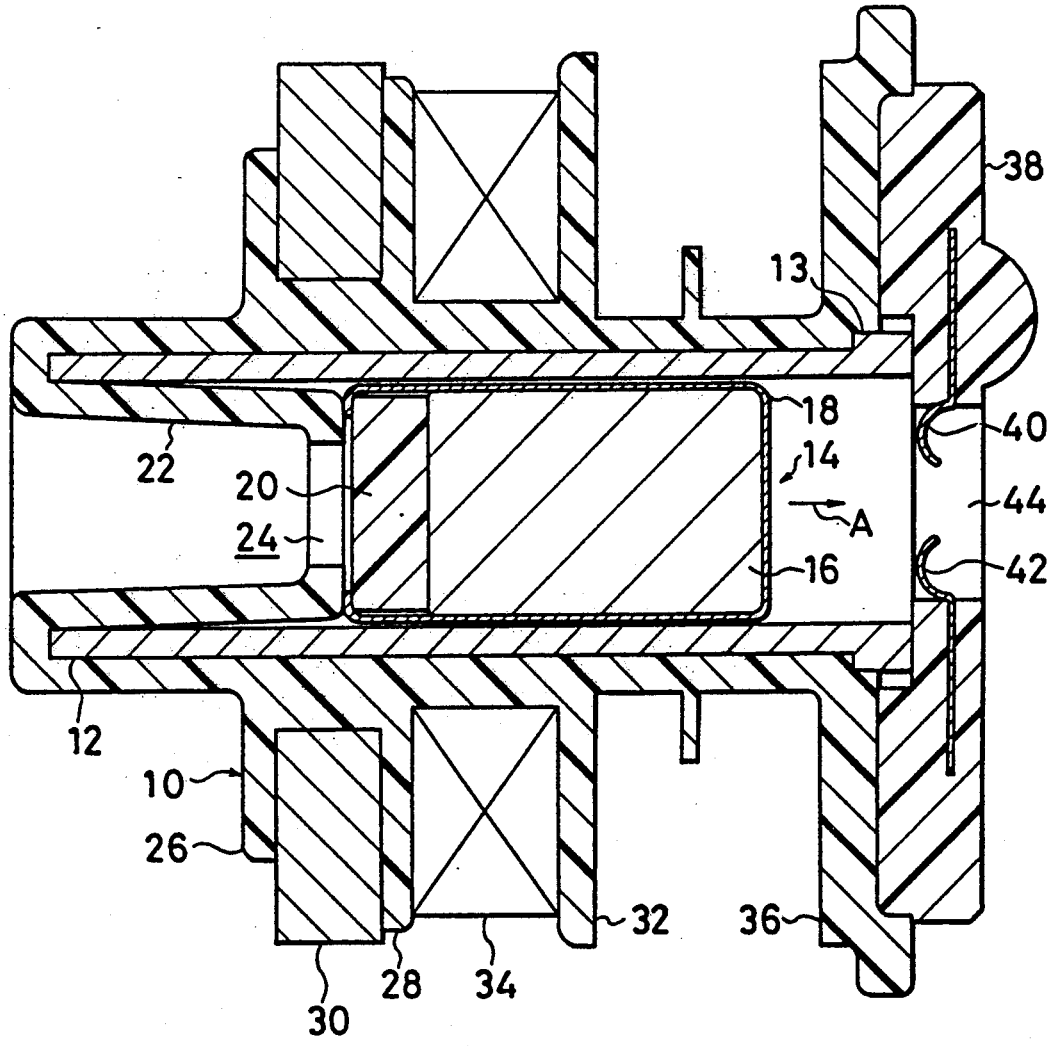
FIG. 1 is a cross-sectional view of an acceleration sensor according to the invention.
Figure 2:
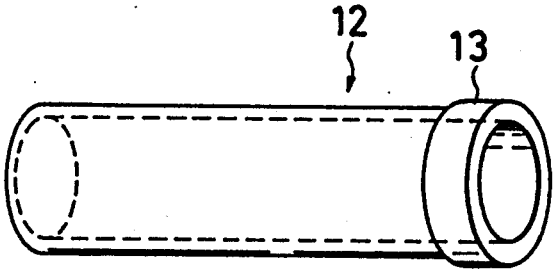
FIG. 2 is a perspective view of a cylinder 12.
Figure 3:
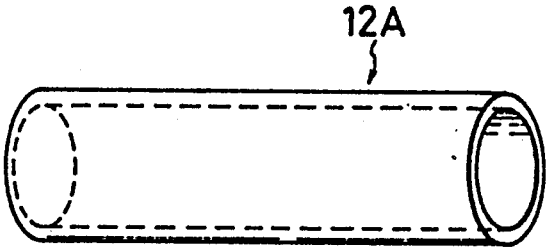
FIG. 3 Prior Art
FIG. 3 is a perspective view of a prior art cylinder 12A.

Referring to the figure, there is shown an acceleration sensor according to the invention. This sensor has a cylindrical bobbin 10 made of a nonmagnetic material such as a synthetic resin. A cylinder 12 made of a copper alloy is held inside the bobbin 10. A magnetized inertial member or magnet assembly 14 is mounted in the cylinder 12. This assembly 14 comprises a core 16 made of a cylindrical permanent magnet, a cylindrical case 18 having a bottom at one end, and a packing 20 made of a synthetic resin. The case 18 is made of a nonmagnetic conductive material such as copper and encloses the core 16. The case 18 is opened at one end thereof. The packing 20 acts to hold the core 16 within the case 18. The magnet assembly 14 is fitted in the cylinder 12 in such a way that it can move longitudinally of the cylinder 12.

The bobbin 10 has an insert portion 22 at its one end. This insert portion 22 enters the cylinder 12. An opening 24 is formed at the front end of the insert portion 22. A pair of flanges 26 and 28 protrude laterally near the front end of the insert portion 22 of the bobbin 10. An annular attracting member or return washer 30 which is made of a magnetic material such as iron is held between the flanges 26 and 28.

The bobbin 10 has another flange 32. A coil 34 is wound between the flanges 28 and 32. A further flange 36 is formed at the other end of the bobbin 10. A contact holder 38 is mounted to this flange 36.

This contact holder 38 is made of a synthetic resin. A pair of electrodes 40 and 42 is buried in the holder 38. An opening 44 is formed in the center of the holder 38. The front ends of the electrodes 40 and 42 protrude into the opening 44. The electrodes 40 and 42 have arc-shaped front end portions. Parts of the arc-shaped front end portions are substantially flush with the front end surface of the cylinder 12.

Lead wires (not shown) are connected with the rear ends of the electrodes 40 and 42 to permit application of a voltage between them.

A thick portion 13 is provided at the front end of the cylinder where the electrodes 40, 42 are placed such that the outside diameter thereof is enlarged. The outside diameter of the thick portion is preferably about 50% to 100% larger than the other portion of the cylinder 12. The length of the thick portion 13 ranges preferably in the longitudinal direction from about 5% to 30% of the cylinder 12.

The operation of the acceleration sensor constructed as described thus far is now described. When no external force is applied, the magnet assembly 14 and the return washer 30 attract each other. Under this condition, the rear end of the magnet assembly 14 is in its rearmost position where it bears against the front end surface of the insert portion 22. If an external force acts in the direction indicated by the arrow A, then the magnet assembly 14 moves in the direction indicated by the arrow A against the attracting force of the return washer 30. This movement induces an electrical current in the cylinder 12 made of a copper alloy, thus producing a magnetic field. This magnetic field applies a magnetic force to the magnet assembly 14 in the direction opposite to the direction of movement. As a result, the assembly 14 is braked.

Where the external force applied to the acceleration sensor is small, the magnet assembly 14 comes to a stop on its way to one end of the cylinder 12. The magnet assembly 14 will soon be returned to its rearmost position shown in FIG. 1 by the attracting force acting between the return washer 30 and the magnet assembly 14.

If a large external force is applied in the direction indicated by the arrow A when the vehicle collides, then the magnet assembly 14 is advanced up to the front end of the cylinder 12 and comes into contact with the electrodes 40 and 42. At this time, the case 18 of the magnet assembly 14 which is made of a conductive material creates a short-circuit between the electrodes 40 and 42, thus producing an electrical current between them. This permits detection of an acceleration change greater than the intended threshold value. Consequently, the collision of the vehicle is detected.

In this embodiment, when the magnet assembly 14 is advanced up to the front end of the cylinder 12, a larger electrical current is induced in the thick portion 13 than in the other portion of the cylinder 12. Therefore, the magnet assembly 14 is braked with a large braking force, so that it becomes contact with the electrodes with a small impact speed whereby the electrodes 40, 42 is prevented to be chattered.

The aforementioned coil 34 is used to check the operation of the acceleration sensor. In particular, when the coil 34 is electrically energized, it produces a magnetic field which biases the magnet assembly 14 in the direction indicated by the arrow A. The magnet assembly 14 then advances up to the front end of the cylinder 12, shortcircuiting the electrodes 40 and 42. In this way, the coil is energized to urge the magnet assembly 14 to move. Thus, it is possible to make a check to see if the magnet assembly can move back and forth without trouble and if the electrodes 40 and 42 can be short-circuited.

What is claimed is:

1. An acceleration sensor comprising:

a cylinder made of a conductive material and having first and second end portions at longitudinal ends thereof, a magnetized inertial member mounted in the cylinder to be movable in a longitudinal direction within the cylinder, a conductive member mounted on at least one end surface within the inertial member facing the first end portion, a pair of electrodes disposed near the first end portion, the electrodes, when contacting the conductive member, being electrically connected to each other through the conductive member, an attracting member disposed near the second end portion of the cylinder and made of a magnetic material, the attracting member magnetically attracting the inertial member, and a thick wall portion of the cylinder formed at the first end portion, the thick wall portion having an outer diameter greater than that of a regular portion of the cylinder so that when the inertial member is moved inside the cylinder upon detection of a predetermined acceleration, the thick wall portion provides a magnetic field stronger than that of the regular portion to reduce speed of the movement of the inertial member to thereby prevent chattering of the inertial member against the electrodes.

2. The acceleration sensor of claim 1, wherein the thick wall portion has a wall thickness 50 to 100% larger than that of the regular portion of the cylinder.

3. The acceleration sensor of claim 1, wherein the length of the thick wall portion is in the range of 5% to 30% in the longitudinal direction of the cylinder.

* * * * *